US006215240B1

(12) United States Patent
Fukuhara

(10) Patent No.: US 6,215,240 B1
(45) Date of Patent: Apr. 10, 2001

(54) COLOR CATHODE-RAY TUBE AND METHOD OF MANUFACTURING THE SAME

(75) Inventor: Naoharu Fukuhara, Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/112,136

(22) Filed: Jul. 9, 1998

(30) Foreign Application Priority Data

Jul. 15, 1997 (JP) ..... 9-189482

(51) Int. Cl.[7] ..... H01J 29/18
(52) U.S. Cl. ..... 313/461; 313/112
(58) Field of Search ..... 313/461–463, 313/466, 112–477 R

(56) References Cited

U.S. PATENT DOCUMENTS 5,686,787 * 11/1997 Itou et al. ..... 313/461
5,754,001 * 5/1998 Ohno et al. ..... 313/112 X
5,914,558 * 6/1999 Kusunoki et al. ..... 313/461 X

FOREIGN PATENT DOCUMENTS 6-295683 10/1994 (JP) .

* cited by examiner

*Primary Examiner*—Ashok Patel
(74) *Attorney, Agent, or Firm*—McGuireWoods, LLP

(57) ABSTRACT

A color cathode-ray tube has a black matrix film having a plurality of light-transmitting windows that are formed on an inner surface of a face panel to have a predetermined positional relationship with each other, filter films formed in the light-transmitting windows to correspond to green, blue, and red, and phosphor films formed by stacking green, blue, and red phosphors on inner surfaces of the filter films. The filter films are made of a photo-tacky resin containing a filter dispersion. A method of manufacturing this color cathode-ray tube is also provided. This method includes the steps of applying a photo-tacky resin containing a desired filter dispersion to the inner surface of the face panel where the back matrix film is formed in advance, exposing the photo-tacky resin in the light-transmitting windows through a shadow mask, applying and drying a phosphor slurry to form the phosphor films, and removing undesired, non-exposed portions of the photo-tacky resin and phosphor films simultaneously.

5 Claims, 5 Drawing Sheets

COLOR CATHODE-RAY TUBE AND METHOD OF MANUFACTURING THE SAME

BACKGROUND OF THE INVENTION

1. Field of the Invention

The present invention relates to a color cathode-ray tube and a method of manufacturing the same and, more particularly, to a color cathode-ray tube in which filter films are disposed between the inner surface of a face panel and phosphor films, and a method of manufacturing the same.

2. Description of the Prior Art

FIG. 1 is a sectional view of the main part of a color cathode-ray tube. As shown in FIG. 1, the outer shape of a color cathode-ray tube 1 consists of a face panel 2 and a funnel 15. A black matrix film 3 and filter films 7 are formed on the inner surface of the face panel 2. The filter films 7 are formed at positions where light-transmitting windows 4 are located. Red, blue, and green phosphor films 8 are formed on the inner surfaces of the filter films 7. The color cathode-ray tube 1 also comprises a shadow mask 9, an electron gun 16, and a deflection coil 17. The shadow mask 9 is arranged at a position slightly remote from the phosphor films 8 to oppose them. The electron gun 16 emits electrons. The deflection coil 17 controls the paths of the electrons.

In recent years, as personal computers spread widely, market requirements for high resolution, high luminance, and the like become more and more intense. In particular, since the graphic display function has become substantial, a further increase in color purity is demanded. As a means for increasing the color purity, a technique for arranging color filter films corresponding to the emission colors of phosphors between the face panel and phosphor films is introduced, as described in Journal of Electrochemical Society, Vol. 28, No. 11 (1981).

FIGS. 2A to 2I are views for explaining the conventional process in the manufacture of filter films and phosphor films. The steps of forming a blue filter film and blue phosphor film will be described as an example.

FIG. 2A is a sectional view showing a state wherein a black matrix film 3 (to be referred to as a BM film hereinafter) and light-transmitting windows 4 are formed on the inner surface of a face panel 2 in advance.

As shown in FIG. 2B, a blue filter solution is applied to cover the BM film 3 and light-transmitting windows 4, to such a degree that the BM film 3 and the face panel 2 sink slightly, and is dried, to form a blue filter layer 7*b* on the entire surface of the face panel 2.

As shown in FIG. 2C, only a required portion, i.e., a desired light-transmitting window 4, of the blue filter layer 7*b* is exposed with ultraviolet light 10 through a shadow mask 9.

As shown in FIG. 2D, since only the exposed portion is water-insoluble, when development is performed with water, other portions that are not exposed are removed, and a desired blue filter film 7B is formed in only the exposed light-transmitting window 4.

Similarly, a green filter film 7G and a red filter film 7R are sequentially formed, as shown in FIG. 2E. In this manner, the desired filter films 7G, 7B, and 7R are formed at predetermined positions on the inner surface of the face panel 2, i.e., in the light-transmitting windows 4.

Phosphor films are formed by coating on the corresponding filter films 7G, 7B, and 7R that are formed with the above method. How to form a blue phosphor film 8B will be described.

As shown in FIG. 2F, a blue phosphor slurry is applied to the upper surfaces of the filter films 7G, 7B, and 7R formed on the inner surface of the face panel 2, and is dried to form a blue phosphor layer 8*b*.

As shown in FIG. 2G, only a required portion of the blue filter layer 8*b*, i.e., the upper surface portion of the blue filter film 7B formed in the above step, is exposed with ultraviolet light 10 through the shadow mask 9.

As shown in FIG. 2H, since only the exposed portion is water-insoluble, when development is performed with water, other portions that are not exposed are removed, and only a desired blue phosphor film 8B that is exposed is formed as it is stacked on the blue filter film 7B.

Similarly, a green phosphor film 8G and a red phosphor film 8R are sequentially formed, as shown in FIG. 2I. In this manner, the phosphor films 8B, 8G, and 8R are formed at predetermined positions on the inner surface of the face panel 2, i.e., such that they are stacked on the filter films 7B, 7G, and 7R, respectively.

As described above, the color cathode-ray tube manufacturing method requires two exposing steps, i.e., one in the filter film forming step of forming the filter films 7B (7G, 7R) and one in the phosphor film forming step of forming the phosphor films 8B (8G, 8R) by stacking them on the filter films 7B (7G, 7R). Due to misalignment between the face panel 2 and the shadow mask 9 and the like, a displacement sometimes occurs between the filter films 7B (7G, 7R) and the phosphor films 8B (8G, 8R). For example, if the green phosphor films 8G are exposed to extend onto the adjacent blue filter films 7B, color mixture occurs to degrade the color purity. Despite that the step of forming the respective filter films and the step of forming the phosphor films are basically identical, these similar steps must be provided as two steps, leading to a very high manufacturing cost.

As a means for solving these problems, for example, Japanese Unexamined Patent Publication No. 6-295683 discloses the following technique. Water-soluble polymers having different cloudy points are used as the base polymers of the filter slurry and the phosphor slurry. A filter layer is formed of the filter slurry having the first cloudy point, and the phosphor layer is formed on it using the phosphor slurry having the second cloudy point. Thereafter, exposure is performed once to eliminate misalignment between filter films and phosphor films.

With this technique, although the entire process is shortened when compared to the conventional manufacturing method, additional steps may be required in accordance with the cloudy point, temperature control must be performed in the process, and factors that largely influence the fraction nondefective may be present.

SUMMARY OF THE INVENTION

The present invention has been made in view of the above situation of the prior art, and has as its object to provide a color cathode-ray tube in which filter films and phosphor films are stacked at high precision, and a color cathode-ray tube manufacturing method that can shorten the manufacturing process and can improve the fraction nondefective.

In order to achieve the above objects, according to the first aspect of the present invention, there is provided a color cathode-ray tube having a black matrix film having a plurality of light-transmitting windows that are formed on an inner surface of a face panel to have a predetermined positional relationship with each other, filter films formed in the light-transmitting windows to correspond to green, blue, and red, and phosphor films formed by stacking green, blue, and red phosphors on inner surfaces of the filter films, the filter films being made of a photo-tacky resin containing a filter dispersion.

The color cathode-ray tube according to the first aspect described above has auxiliary aspects as follows.

The green, blue, and red phosphors are fixed and stacked due to tackiness of the photo-tacky resin that forms the filter films.

The photo-tacky resin containing the filter dispersion consists of a fine-particle material having wavelength selectivity, and the fine-particle material is a pigment.

The tackiness of the photo-tacky resin that forms the filter films is exhibited upon exposure.

In order to achieve the above objects, according to the second aspect of the present invention, there is provided a method of manufacturing a color cathode-ray tube having a black matrix film having a plurality of light-transmitting windows that are formed on an inner surface of a face panel to have a predetermined positional relationship with each other, filter films formed in the light-transmitting windows to correspond to green, blue, and red, and phosphor films formed by stacking green, blue, and red phosphors on inner surfaces of the filter films, the method comprising the steps of applying a photo-tacky resin containing a desired filter dispersion to the inner surface of the face panel where the back matrix film is formed in advance, exposing the photo-tacky resin in the light-transmitting windows through a shadow mask, applying and drying a phosphor slurry to form the phosphor films, and removing undesired, non-exposed portions of the photo-tacky resin and phosphor films simultaneously.

With the color cathode-ray tube and the method of manufacturing the same having the above aspects, when the filter films are exposed, the filter films can exhibit tackiness. Therefore, green, blue, and red phosphors can be easily formed to be stacked on the inner surfaces of the respective filter films corresponding to green, blue, and red. The filter films and phosphor films can be formed with only one exposing operation in a series of steps, and development of the filter films and development of the phosphor films can be performed simultaneously, thus shortening and simplifying the manufacturing process. The number of conventional exposing steps causing a maximum number of defectives is reduced to only one. As a result, a color cathode-ray tube having both the improved luminance and contrast at a high yield can be provided although it requires filter film formation.

The above and many other objects, features and advantages of the present invention will become manifest to those skilled in the art upon making reference to the following detailed description and accompanying drawings in which preferred embodiments incorporating the principles of the present invention are shown by way of illustrative examples.

DETAILED DESCRIPTION OF THE PREFERRED EMBODIMENT

Figure 1:
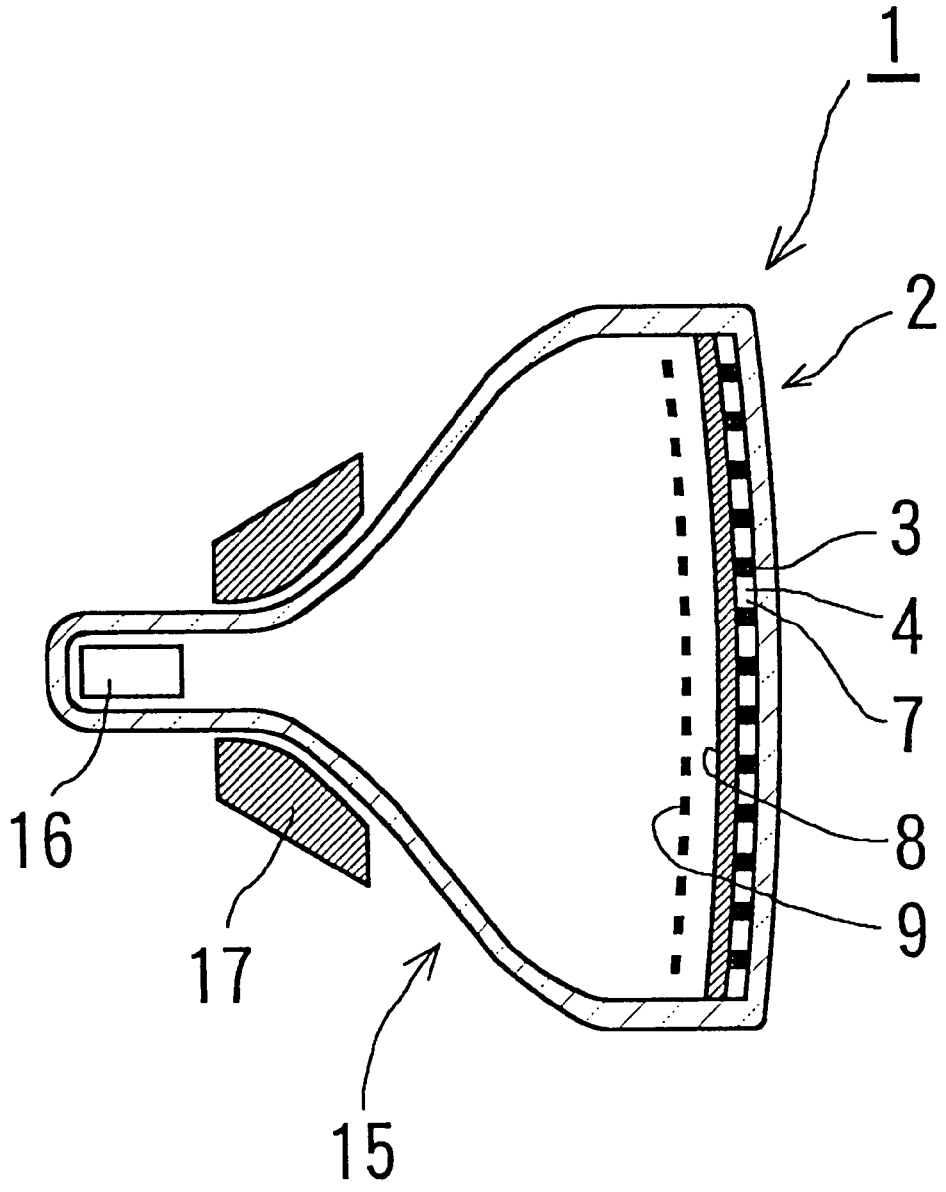
FIG. 1 PRIOR ART
FIG. 1 is a schematic sectional view of the main part of a conventional color cathode-ray tube.
Figure 2A:
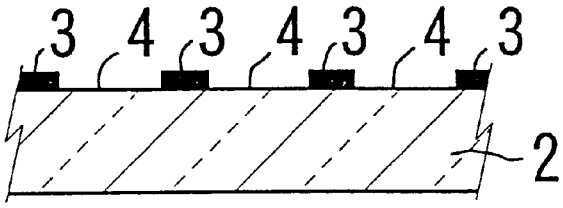
FIG. 2A PRIOR ART
FIGS. 2A to 2I are sectional views showing a conventional method of manufacturing filter films and phosphor films in the order of steps.
Figure 2B:
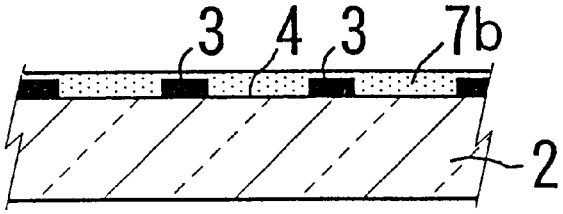
FIG. 2B PRIOR ART
Figure 2C:
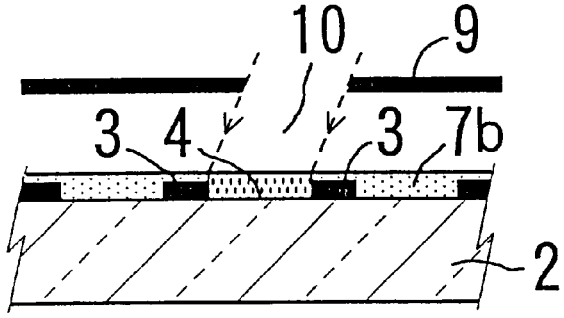
FIG. 2C PRIOR ART
Figure 2D:
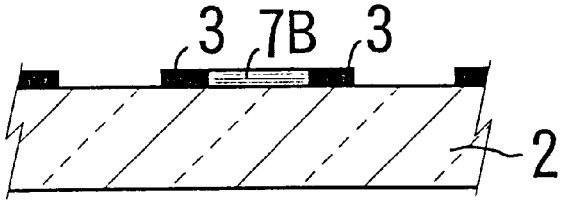
FIG. 2D PRIOR ART
Figure 2E:
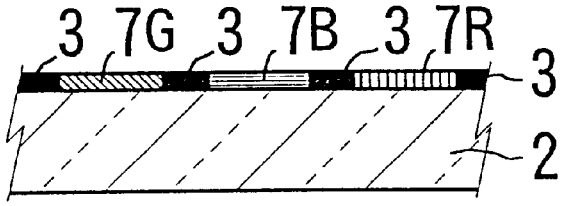
FIG. 2E PRIOR ART
Figure 2F:
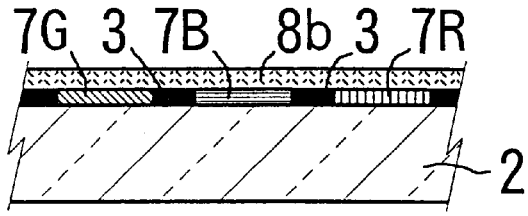
FIG. 2F PRIOR ART
Figure 2G:
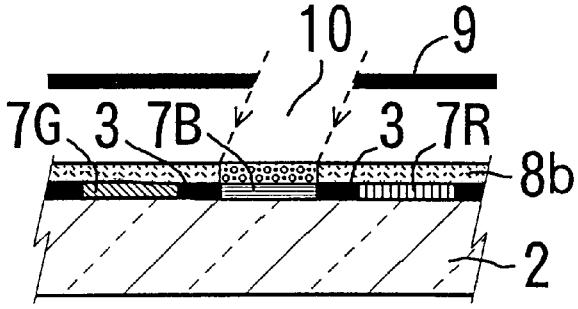
FIG. 2G PRIOR ART
Figure 2H:
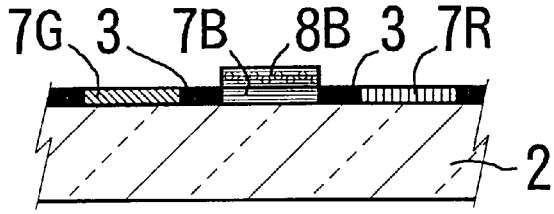
FIG. 2H PRIOR ART
Figure 2I:
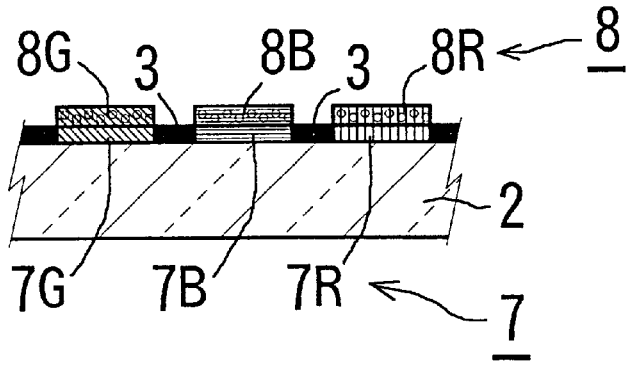
FIG. 2I PRIOR ART

A preferred embodiment of the present invention will be described with reference to the accompanying drawings.

As shown in FIG. 3 and FIGS. 4A to 4F, reference numeral 1 denotes a color cathode-ray tube; 2, a face panel; 3, a black matrix film; 4, light-transmitting windows; 5, filter films; 6, phosphor films; and 9, a shadow mask.

The filter films 5 have a green filter film 5G, a blue filter film 5B, and a red filter film 5R each made of a photo-tacky resin containing a filter dispersion, and the phosphor films 6 are formed of a green phosphor film 6G, a blue phosphor film 6B, and a red phosphor film 6R corresponding to the respective filter films 5.

Figure 3:
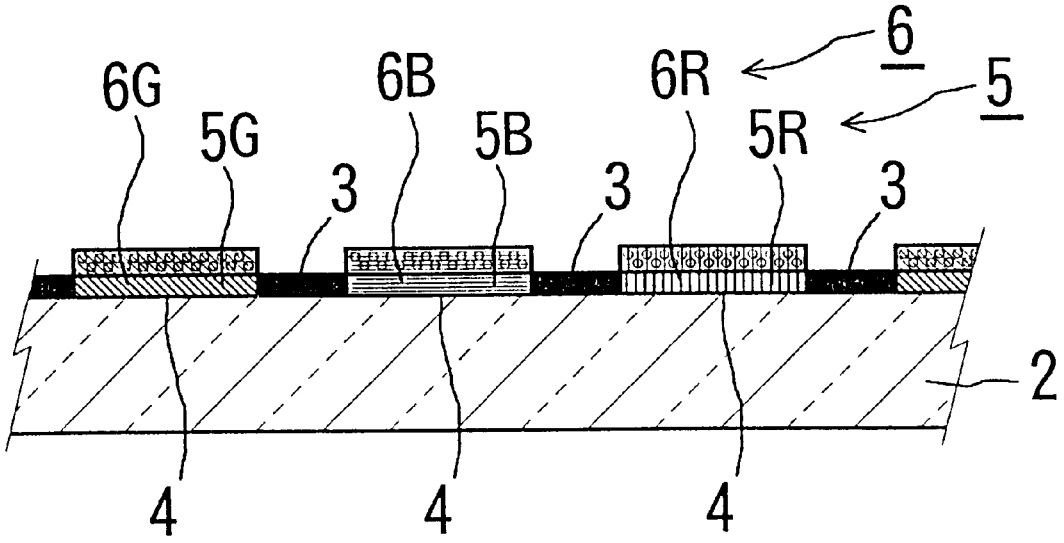
FIG. 3 is a schematic sectional view of the main part of the face panel portion of a color cathode-ray tube according to the present invention.

FIG. 3 is a schematic sectional view of the main part of the face panel portion of the color cathode ray tube according to the present invention. As shown in FIG. 3, the BM film 3 and the light-transmitting windows 4 are formed on the inner surface of the face panel 2 in advance. The filter films 5G, 5B, and 5R are formed on the light-transmitting windows 4. The phosphor films 6G, 6B, and 6R are formed and precisely stacked on the filter films 5G, 5B and 5R to correspond to them.

The characteristic feature of the color cathode-ray tube 1 according to the present invention resides in the filter films 5 formed between the inner surface of the face panel 2 and the phosphor films 6, and aims at fixing and forming the phosphor films 6 by utilizing the photo-tacky properties of the filter films 5. The filter films 5 are made of a photo-tacky resin containing a filter dispersion. The photo-tacky resin uses a fine-particle material having wavelength selectivity, i.e., a pigment. In addition, as the photo-tacky resin, a material that exhibits tackiness upon exposure is selected.

FIGS. 4A to 4F are views for explaining the steps of forming the filter films and phosphor films on the face panel 2 shown in FIG. 3. In this case, a method of forming the blue filter film 5B and the blue phosphor film 6B will be described as an example of the embodiment in the order of steps.

Figure 4A:
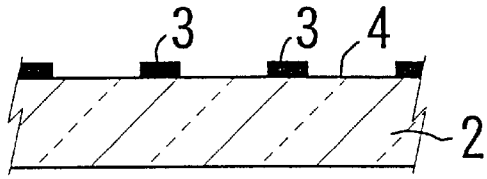
FIGS. 4A to 4F are sectional views showing a method of manufacturing the filter films and phosphor films of the face panel portion shown in FIG. 4 in the order of steps.
Figure 4B:
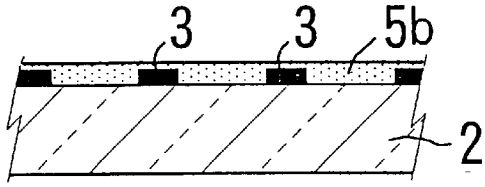

FIG. 4A is a sectional view of the inner surface of the face panel 2 on which the light-transmitting windows 4 and BM film 3 are formed in advance. As shown in FIG. 4B, a blue filter layer 5*b* dispersed with fine particles, which have wavelength selectivity to exhibit tackiness and to be set upon exposure, is applied to this face panel 2.

For example, the blue filter layer 5*b* in this case basically has the following composition ratio:

| | |
|---|---|
| polyvinyl alcohol | 4.2 wt % |
| cobalt aluminate (fine particles) | 16.5 wt % |
| Nonchron N-19 | 25.7 wt % |
| pure water | balance |

This composition is changed depending on the various conditions. Although Nonchron N-19 (tradename available from TOKYO OHKA KOGYO CO., LTD.) is used as the photosensitive material, it can be any other photosensitive material as far as it exhibits tackiness upon irradiation with light.

Figure 4C:
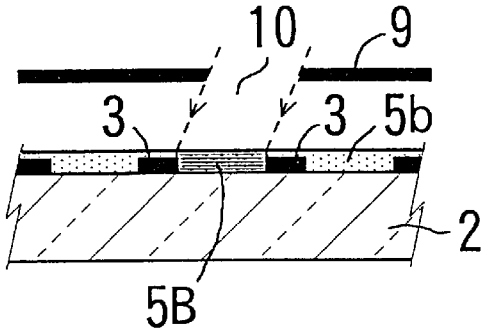

As shown in FIG. 4C, only the required portion of the blue filter layer 5*b*, i.e., the light-transmitting window 4, is irradiated with ultraviolet light 10 so as to be exposed, thereby forming the blue filter film 5B.

Figure 4D:
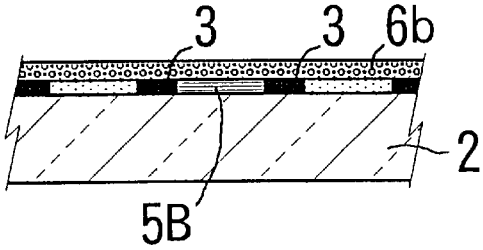

As shown in FIG. 4D, a blue phosphor slurry obtained by mixing a blue phosphor and pure water at a ratio of, e.g., 50:50, is applied to the entire surfaces of the blue filter films 5B and is dried to form a blue phosphor layer 6*b*. Thereafter, the blue phosphor layer 6*b* is developed with water. The mixing ratio of blue phosphor and pure water is arbitrarily selected in accordance with the various process conditions.

Figure 4E:
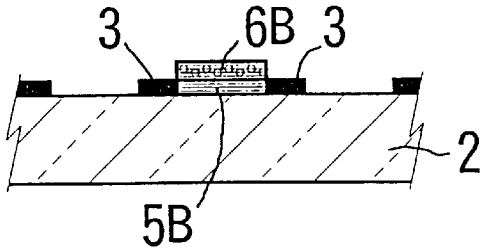

As shown in FIG. 4E, the portion of the blue filter film 5B that is exposed in the previous step exhibits tackiness upon exposure, as described above. The blue phosphor layer 6*b* is therefore fixed to the upper surface of the blue filter film 5B. When development is performed, non-exposed portions are removed, and only the blue filter film 5B and the blue phosphor film 6B formed on its upper surface are left.

Figure 4F:
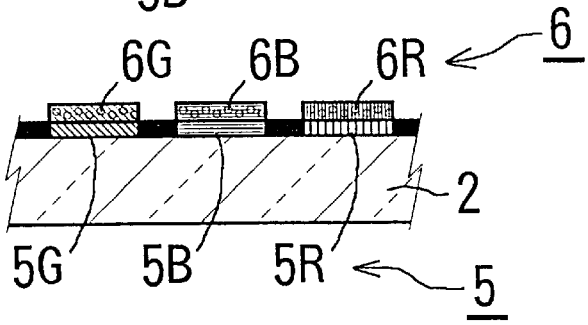

Similarly, on the inner surface of the face panel 2, the green phosphor film 6G and the red phosphor film 6R are formed to be stacked on the upper surface of the green filter film 5G and the upper surface of the red filter film 5R, respectively, as shown in FIG. 4F.

For example, as the material of the green filter film 5G, Cobalt Green ($TiO_2.CoO.NiO.ZrO_2$, $CoO.Cr_2O_3.TiO_3.AL_2O_3$) or the like is used. As the material of the red filter film 5R, iron oxide ($Fe_2O_3$) or the like is available. Materials corresponding to the wavelengths that are required in the respective phosphor colors may be selected.

As described above, since the surfaces of the filter films 5G, 5B, and 5R of the respective colors exhibit tackiness upon exposure, the phosphor films 6G, 6B, and 6R of the respective colors are formed such that they are fixed to and stacked on the upper surfaces of the filter films 5G, 5B, and 5R. Thus, the exposure step is required only once. This prevents stacking misalignment, between the respective filter films and phosphor films, which conventionally occurs due to two exposing operations, i.e., one in the filter film forming step and one in the phosphor film forming step, as described in the prior art. As a result, a color cathode-ray tube having high color purity can be obtained.

Since the filter films 5G, 5B, and 5R of the respective colors have tackiness, the respective phosphor films 6G, 6B, and 6R can be fixed to and formed on the upper surfaces of the filter films 5G, 5B, and 5R. Accordingly, separate exposure operations need not be performed to form the phosphor films 6G, 6B, and 6R, and the filter films 5G, 5B, and 5R and the phosphor films 6B, 6G, and 6R can be developed simultaneously. This greatly shortens the manufacturing process when compared to the prior art, and can be equivalent to a manufacturing process for a color cathode-ray tube having no filter films 5G, 5B, and 5R but only phosphor films 6G, 6B, and 6R. As a result, the conventional step which causes the defectives, e.g., the exposing step is performed only once, so that production can be performed without decreasing the fraction nondefective.

What is claimed is:

1. A color cathode-ray tube having a black matrix film having a plurality of light-transmitting windows that are formed on an inner surface of a face panel to have a predetermined positional relationship to each other, filter films formed in said light-transmitting windows to correspond to green, blue and red, and phosphor films formed by stacking green, blue and red phosphors on inner surfaces of said filter films, said filter films being made of a photo-tacky resin fixing said phosphor films thereto and containing a filter dispersion.

2. A cathode-ray tube according to claim 1, wherein said green, blue, and red phosphors are stacked and fixed due to tackiness of said photo-tacky resin that forms said filter films.

3. A cathode-ray tube according to claim 1, wherein said photo-tacky resin containing said filter dispersion consists of a fine-particle material having wavelength selectivity.

4. A cathode-ray tube according to claim 3, wherein said fine-particle material is a pigment.

5. A cathode-ray tube according to claim 2, wherein the tackiness of said photo-tacky resin that forms said filter films is exhibited upon exposure.

* * * * *